US005646517A

United States Patent [19]

Belot et al.

[11] Patent Number: 5,646,517

[45] Date of Patent: Jul. 8, 1997

[54] VOLTAGE REGULATOR FOR COUPLED-MODE LOGIC CIRCUITS

[75] Inventors: Didier Belot, Rives; Patrick Bernard, Poisat, both of France

[73] Assignee: SGS-Thomson Microelectronics S.A., Saint Genis, France

[21] Appl. No.: 561,520

[22] Filed: Nov. 22, 1995

[30] Foreign Application Priority Data

Nov. 30, 1994 [FR] France ..... 94 14604

[51] Int. Cl.[6] ..... G05F 3/16

[52] U.S. Cl. ..... 323/313; 323/907

[58] Field of Search ..... 323/312, 313, 323/314, 315, 317, 901, 907; 327/512, 530, 538

[56] References Cited

U.S. PATENT DOCUMENTS

| | | | |
|---|---|---|---|
| 458,088 | 4/1891 | Bloomer | 323/238 |
| 4,234,841 | 11/1980 | Schade, Jr. | 323/1 |
| 4,556,807 | 12/1985 | Yamada et al. | 307/491 |
| 4,633,162 | 12/1986 | Melbert | 323/275 |
| 4,751,404 | 6/1988 | Yuen | 307/297 |
| 4,857,823 | 8/1989 | Bitting | 323/314 |
| 4,943,737 | 7/1990 | Guo et al. | 307/296.7 |
| 5,084,665 | 1/1992 | Dixon et al. | 323/281 |
| 5,121,049 | 6/1992 | Bass | 323/313 |
| 5,208,527 | 5/1993 | Poletto | 323/313 |

OTHER PUBLICATIONS

Proceedings of the Bipolar Circuits and Technology Meeting, Minneapolis, Sep. 18–19, 1989, pp. 131–134, Banaccio A.R., et al., "A Bifet Differential Current–Mode Transceiver for the Intelligent Peripheral Interface".

Motorola Technical Developments, vol. 9, Auguat 1989, pp. 83–84, Davis D.E., "Low Noise, Low Power Voltage Reference".

*Primary Examiner*—Edward Tso
*Assistant Examiner*—Adolf Berhane
*Attorney, Agent, or Firm*—Wolf, Greenfield & Sacks, P.C.; James H. Morris

[57] ABSTRACT

A voltage regulator controls at least one current source of at least one coupled-mode logic gate. The voltage regulator includes a first current source, of a bipolar-type, connected between ground and a first resistor that is connected to a supply voltage. The first current source is controlled by a voltage across a second resistor that is fed by a current from a second current source of a MOS-type. The current value of the second source determines the voltage of an output terminal of the regulator by duplicating this current on a third current source that is mirror-connected to the second source.

29 Claims, 2 Drawing Sheets

VOLTAGE REGULATOR FOR COUPLED-MODE LOGIC CIRCUITS

BACKGROUND OF THE INVENTION

1. Field of the Invention

The present invention relates to a reference voltage source for controlling a current source of a coupled-mode logic (CML) circuit. It more particularly relates to the fabrication of a voltage regulator operating at a low, 3-volt, supply voltage.

2. Discussion of the Related Art

There are two main types of coupled-mode logic circuits: emitter-coupled logic (ECL) circuits fabricated from bipolar transistors, and source-coupled logic (SCL) circuits fabricated from MOS transistors.

In any logic circuit, it is desirable to provide the lowest possible supply voltage in order to have a minimum energy consumption. However, the minimum value of the supply voltage is limited by the circuits that are used to provide the current sources of the logic circuit with a steady reference voltage despite variations of the supply voltage Vcc or of the operating temperature, in order to maintain a constant input or output level difference of logic gates. This difference can be expressed for an ECL circuit as being the voltage difference $\Delta V$ between two complementary outputs of the logic gate. In an SCL circuit, this difference can be expressed as being the voltage difference $\Delta V$ between two complementary inputs of the logic gate.

The difference $\Delta V$ between two levels of a logic gate, either in ECL or SCL circuits is, for example, 0.4 volt.

The selection between bipolar or MOS technologies of the logic circuits mainly depends on the use of the circuit. For example, if the circuit requires high switching speeds, logic gates are generally fabricated according to the ECL technique.

In BICMOS circuits using both bipolar and CMOS technologies on the same chip, the two types of logic circuits can be implemented. Then, voltage regulators for controlling the current sources are fabricated with bipolar transistors for the ECL circuits and with MOS transistors for the SCL circuits, respectively. In addition, conventional regulators using bipolar transistors do not make it possible to decrease the supply voltage to approximately 3 volts.

SUMMARY OF THE INVENTION

An object of the present invention is to provide a BICMOS voltage regulator which can be designed for current sources of an ECL or SCL circuit while using a low supply voltage of approximately 3 volts.

To achieve this oDject, in an embodiment of the present invention, a voltage regulator is provided for controlling at least a current source of at least one coupled-mode logic gate. The voltage regulator includes a first current source, of the bipolar-type, connected between ground and a first resistor. The first resistor is also connected to a supply voltage. The first current source is controlled by a voltage across a second resistor fed by a current that is provided by a second current source of the MOS-type. The value of a current of the second source determines the voltage of an output terminal of the regulator by duplicating the current on a third current source mirror-connected to the second source.

According to another embodiment of the invention, the second current source includes a P-channel MOS transistor having a source connected to the supply voltage, and a gate connected to a drain and to a gate of a P-channel MOS transistor which constitutes the third current source. The drain of the MOS transistor of the third current source constitutes the output terminal of the regulator.

According to another embodiment of the invention, the regulator includes a first voltage source of a bipolar-type connected in series to a second voltage source of a reverse polarity that transfers a voltage across the first current source to the second resistor.

According to another embodiment of the invention, the regulator further includes switches for preventing the regulator from consuming energy when it is not in use.

According to another embodiment of the invention, the first current source includes first and second mirror-connected NPN bipolar transistors. The emitter of the first transistor is connected to ground through two resistors connected in series, and the emitter of the second transistor is connected to a junction between the two resistors. The bases of the first and second NPN transistors constitute a control terminal of the current source, and the collector of the second NPN transistor constitutes an output terminal connected to the first voltage source.

According to another embodiment of the invention, the first voltage source is constituted by a PNP bipolar transistor having a collector connected to ground, a base connected to the second NPN transistor of the first current source, and an emitter connected to a gate of an N-channel MOS transistor of the second voltage source. The source of the MOS transistor of the second voltage source is connected to ground, and the drain is connected to the drain of the MOS transistor of the second current source.

According to another embodiment of the invention, the first resistance includes first, second and third P-channel MOS transistors having sources connected to the supply voltage through a first switch, gates connected to a start device, and drains. The drains of the first and second P-channel MOS transistors are respectively connected to the collectors of the first and second NPN transistors of the first current source. The drain of the third current source is coupled to the emitter of the transistor which constitutes the first voltage source.

According to another embodiment of the invention, the voltage regulator of the previous embodiment is in combination with a current source of a logic gate that includes an N-channel MOS transistor whose gate and drain are interconnected and connected to the output terminal of the voltage regulator. The source of the N-channel MOS transistor is connected to ground.

According to another embodiment of the invention, a voltage regulator comprises a voltage-to-current converter connected between an output terminal of the voltage regulator and ground. The converter includes an NPN bipolar transistor having its emitter connected to ground through a resistor and its collector connected to the output terminal of the voltage regulator. The voltage regulator is in combination with a current source of a logic gate that includes an NPN bipolar transistor having its emitter connected to ground through a resistor. The NPN bipolar transistor of the current source is mirror-connected to the NPN bipolar transistor of the current-to-voltage converter.

According to still another embodiment of the invention, the voltage regulator further comprises an NPN bipolar compensation transistor for compensating for base currents of a current source of a logic gate connected to the voltage regulator. The base of the compensation transistor is connected to an output terminal of the regulator. The compensation transistor has a collector connected to a supply voltage and an emitter connected to the base of a transistor of a current-to-voltage converter.

The foregoing and other objects, features, aspects and advantages of the invention will become apparent from the following detailed description of the present invention when taken in conjunction with the accompanying drawings.

DETAILED DESCRIPTION

Figure 1:
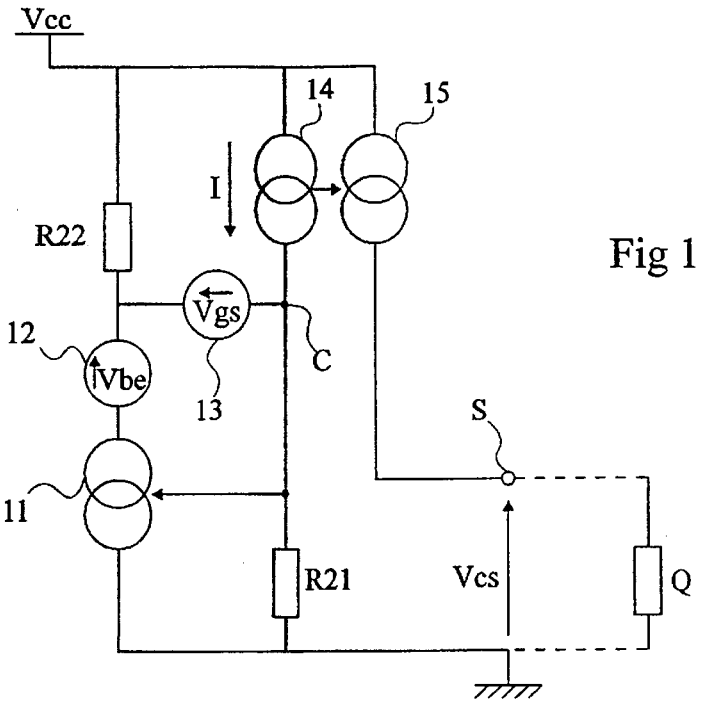
FIG. 1 is a schematic diagram of an embodiment of a voltage regulator according to one aspect of the invention.

A voltage regulator according to one embodiment of the invention, as represented in FIG. 1, comprises a first current source 11 controlled by the voltage across a resistor R21 disposed between ground and a node C of the circuit. Source 11, fabricated according to a bipolar technology, is disposed between ground and a first voltage source 12 that is connected to the supply voltage through a resistor R22. The junction between resistor R22 and the voltage source 12 is connected to node C through a second voltage source 13. Node C is connected to the supply voltage Vcc through a second current source 14 fabricated according to a MOS technology. A third current source 15, also fabricated according to a MOS technology, is mirror-connected to an output terminal S of the regulator. The output voltage Vcs at terminal S is fixed by the value of resistor 21 and by the value of current I provided by the current source 14 and mirrored on source 15.

The voltage of the output terminal S is equal to the voltage of node C that corresponds to the product of resistor R21 by current I. The voltage of node C is temperature-regulated by source 11. In addition, since the voltage of node C is determined by source 11 with respect to ground, it is independent of the supply voltage Vcc.

The voltage source 12 compensates for the voltage drop caused by source 13 that constitutes a voltage follower for duplicating the voltage across source 11 onto node C.

A temperature variation causes the value of resistor R21 to vary. This variation is compensated for by a voltage variation at node C through source 11. Thus, the voltage Vcs of the output terminal S provided at the terminals of a load Q is independent of the temperature and of the supply voltage Vcc.

The minimum supply voltage of the regulator according to the invention can be low, as will be described with relation to each of the following embodiments.

An advantage of the present invention over the prior art is that such a regulator can be used to control current sources either of a bipolar-type or of a MOS-type.

Figure 2:
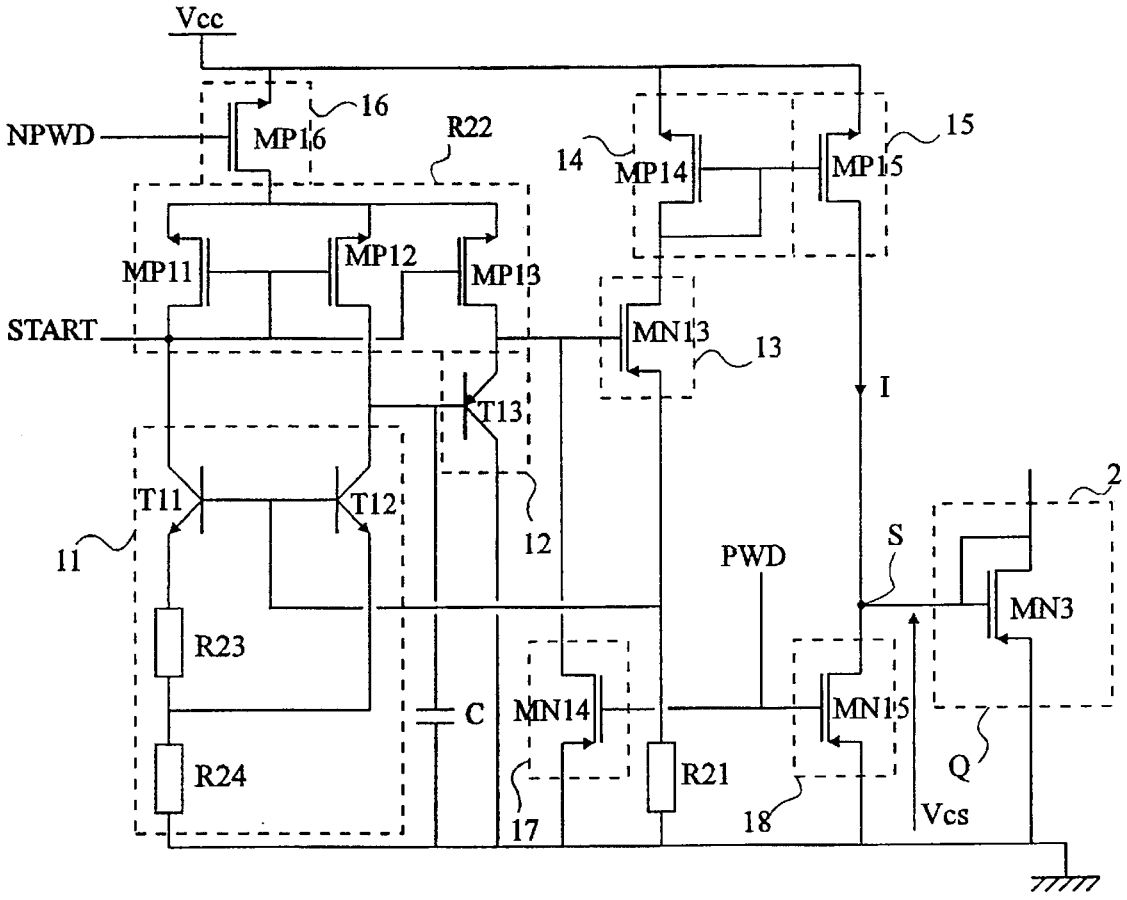
FIG. 2 is a detailed diagram of an embodiment of a regulator according to the present invention for current sources fabricated according to a MOS technology.

If MOS technology is used for the current sources of the logic circuit, load Q, such as represented in FIG. 1, is directly constituted by these current sources. FIG. 2 illustrates this application.

Figure 3:
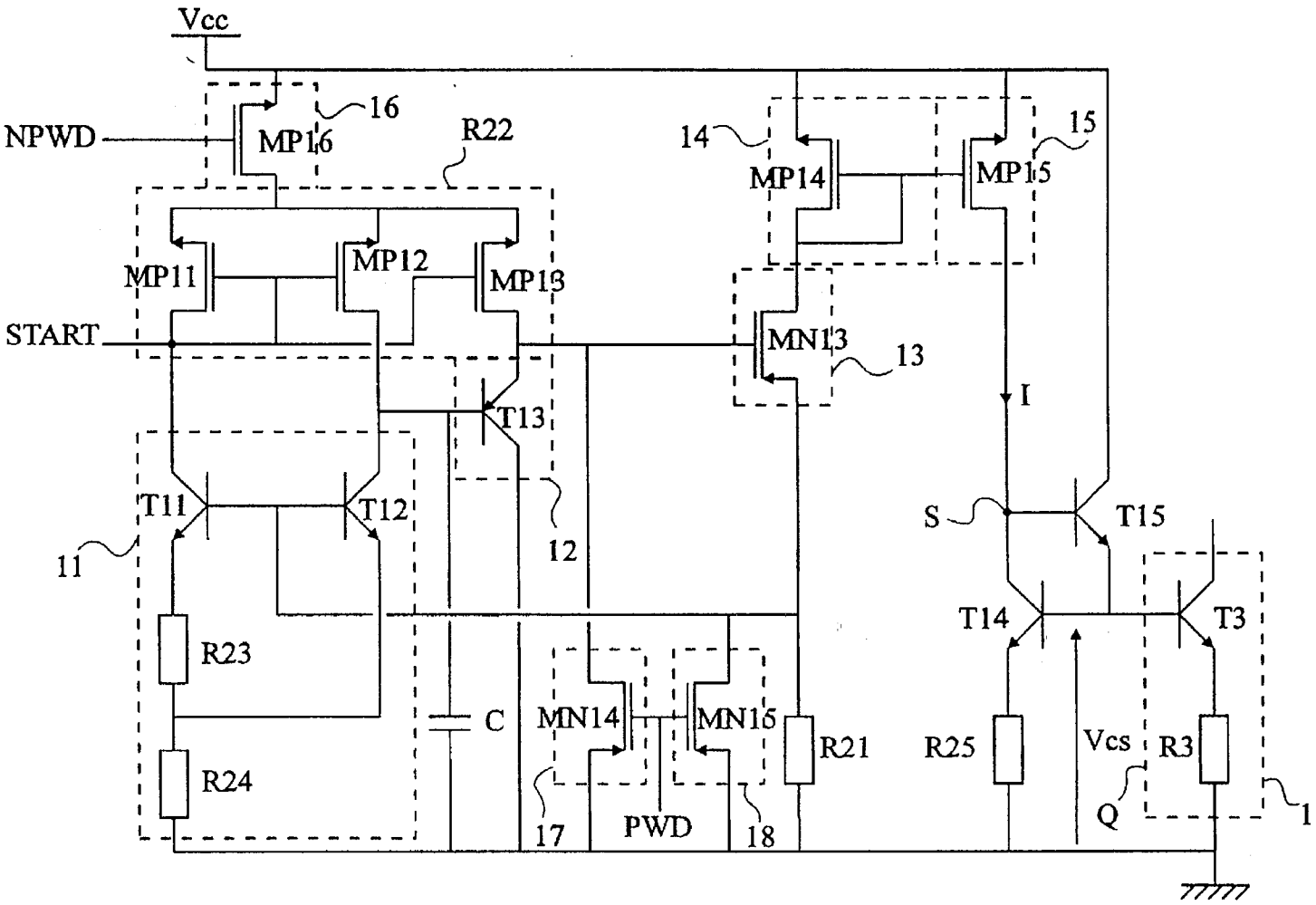
FIG. 3 is a detailed diagram of an embodiment of a regulator according to the present invention for current sources fabricated according to a bipolar technology.

If a bipolar technology is used for the current sources of the logic circuit, the invention provides an adaptation of the device output to allow a current control from source 15 that is in a MOS technology. FIG. 3 illustrates this application.

FIG. 2 is a diagram of a regulator as shown in FIG. 1 for controlling the current sources of a logic circuit fabricated with MOS transistors.

The current source 11 is constituted by two NPN bipolar transistors T11 and T12 having a predetermined surface ratio and having their bases interconnected and connected to a first terminal of resistor R21. The other terminal of resistor R21 is connected to ground. The emitter of transistor T11 is connected to ground through two resistors R23 and R24 connected in series. The junction of resistors R23 and R24 is connected to the emitter of transistor T12. The collectors of transistors T11 and T12 are connected to the drains of the two P-channel MOS transistors MP11 and MP12, respectively. The gates of transistors MP11 and MP12 are connected together to the drain of transistor MP11. The sources of transistors MP11 and MP12 are connected together to the supply voltage Vcc through a first switch 16 whose function will be explained hereinafter.

The collector of transistor T12 that constitutes the output of the current source 11 is connected to the base of a PNP bipolar transistor T13 that forms the voltage source 12. The collector of transistor T13 is connected to ground and its emitter is connected to the drain of a P-channel MOS transistor MP13, and to the gate of an N-channel MOS transistor MN13. Transistors MP11, MP12 and MP13 correspond to resistor R22 represented in FIG. 1. The gate of transistor MP13 is connected to the drain of transistor MP11 and constitutes an input terminal designated as START for coupling to a start aid device of the regulator. At the powering on of the circuit, the start aid device is used to reduce the voltage at the gate of transistors MP11, MP12 and MP13 to be lower than the supply voltage Vcc less the voltage drop caused by the internal resistance of switch 16 when turned on. The start aid device is a conventional device (not shown). The input terminal START may correspond to the emitter of transistor T11.

Transistor MN13 constitutes the voltage source 13 of the circuit shown in FIG. 1. The source of transistor MN13 is connected to ground through resistor R21, and its drain is connected to the drain of a P-channel MOS transistor MP14. Transistor MP14 constitutes the current source 14 of FIG. 1. The source of transistor MP14 is connected to the supply voltage Vcc, and its gate is connected to its own drain and to the gate of a P-channel MOS transistor MP15. The transistor MP15 constitutes the current source 15. Transistor MP15 has a source connected to the supply voltage Vcc, and a drain that constitutes the output terminal S of the regulator.

The regulator further comprises two additional switches 17 and 18. Switch 17 is constituted by an N-channel MOS transistor MN14, having its source connected to ground and its drain connected to the gate of transistor MN13. The gate of transistor MN14 is connected to a control terminal PWD. Switch 18 is constituted by an N-channel MOS transistor MN15 having its source connected to ground and its drain connected to the output terminal S of a regulator. The gate of transistor MN15 is connected to the control terminal PWD. Switch 16 is constituted by a P-channel MOS transistor MP16 having its source connected to the supply voltage and its drain connected to the sources of transistors MP11, MP12 and MP13. The gate of transistor MP16 is connected to a control terminal NPWD. Switches 16, 17 and 18 prevent the regulator from consuming current, when it is not in use, by the action of a control signal PWD and its inverted signal NPWD. When the regulator operates, the switch 16 is turned on (transistor MP16 is conductive) and switches 17 and 18 are turned off (transistors MP14 and MP15 are blocked).

A capacitor C is interposed between the base of transistor T13 and ground to provide an a.c. ground at the base of transistor T13.

In this example, load Q is constituted by one or more current sources 2 of an SCL circuit. The current sources include an N-channel MOS transistor MN13 having its source connected to ground and its drain connected to its own gate and to the sources of the MOS transistors (not shown) of the SCL circuit. The gate of transistor MN3 constitutes the control input of the current source 2.

The voltage Vcs across load Q is equal to R21*I, where I is the current of source 14.

The minimum operating supply voltage of such a regulator is substantially 2.2 volts, which corresponds to two threshold voltages of a MOS transistor (transistors MP14 and MN13) and to a base-emitter voltage (of transistor T12).

By way of example, a regulator such as represented in FIG. 2 fabricated with the following resistor values and gate width/length (W/L) ratios for the MOS transistors provides an operation range for the supply voltage from 2.2 to 7 volts and a Vcs voltage of 0.4 volt.

| | |
|---|---|
| $R21 = 30\ k\Omega$; | $R23 = 10.8\ k\Omega$; |
| $R24 = 74.1\ k\Omega$; | $W/L(MP11, MP12) = 40:5$; |
| $W/L(MP13) = 10:2$; | $W/L(MP14) = 100:3$; |
| $W/L(MP15) = 600:3$; | $W/L(MP16, MN13) = 100:0.7$; |
| $W/L(MN14, MN15) = 3:1$. | |

FIG. 3 is a schematic diagram of a regulator represented by FIG. 1 for controlling current sources of a logic circuit fabricated with bipolar transistors.

The regulator of FIG. 3 is similar to the regulator of FIG. 2. The same elements are designated with the same references.

In FIG. 3, the load Q is constituted by one or more current sources 1 of an ECL logic gate. The current sources include an NPN bipolar transistor T3 having its emitter connected to ground through a resistor R3 and its collector connected to the emitters of bipolar transistors (not shown) of the ECL circuit. The base of transistor T3 constitutes the control input of the current source 1.

The drain of transistor MP15 does not directly form the output terminal S of the regulator, but is connected to the collector of an NPN bipolar transistor T14 having its emitter connected to ground through a resistor R25. Transistor T14 acts as a voltage-to-current converter for controlling the current of the bipolar transistors T3 of loads Q. Transistors T3 of loads Q are mirror-connected to transistor T14.

Transistor T14 is added because the current sources, fabricated in a bipolar technology, are current-controlled, whereas in MOS technology, the current sources are voltage-controlled.

To compensate for the base currents of transistor T14 and of one or more transistors T3, an NPN bipolar transistor T15 is connected through its base to the drain of transistor MP15, its collector is connected to the supply voltage Vcc, and its emitter is connected to the base of transistor T14. The transistor T15 provides a sufficient current to control a large number of sources 1 with only one regulator.

Switch 18 in the regulator of FIG. 3 is connected in parallel with resistor R21. Switch 18 acts on the bases of transistors T11 and T12.

In the regulator of FIG. 3, the voltage Vcs of the regulator is equal to R25*I+$Vbe_{14}$, where $Vbe_{14}$ is the base-emitter voltage of transistor T14 and where I is the current mirrored on source 14.

All the other components shown in FIG. 3 are identical to the corresponding components of FIG. 2.

The minimum operating supply voltage of the regulator shown in FIG. 3 is approximately 2.5 volts which corresponds to the threshold voltage of transistor MP15 and to two base-emitter voltages (voltages of transistors T14 and T15). The maximum value of the current that can be provided to control transistors T3 of sources 1 is approximately 1 mA, which corresponds to the control of approximately four hundred sources 1.

By way of example, a regulator such as represented in FIG. 3, fabricated with the following values for the resistors and with width/length ratios W/L for the MOS transistors, provides an operation range for a supply voltage from 2.5 to 7 volts, and a voltage Vcs of 0.4 volt.

| | |
|---|---|
| $R21 = 30\ k\Omega$; | $R23 = 10.8\ k\Omega$; |
| $R24 = 74.1\ k\Omega$; | $R25 = 1\ k\Omega$ |
| $W/L(MP11, MP12) = 40:10$; | $W/L(MP13) = 10:5$; |
| $W/L(MP14) = 200:6$; | $W/L(MP15) = 2050:10$; |
| $W/L(MP16, MN13) = 100:0.7$; | $W/L(MN14, MN15) = 3:1$. |

Thus the present invention allows the use of a low supply voltage of approximately 3 volts for current sources of the bipolar or MOS-type. In addition, the voltage Vcs provided by the regulator is steady when the temperature and/or the supply voltage varies.

As is apparent to those skilled in the art, various modifications can be made to the above disclosed preferred embodiments. In particular, each described component can be replaced with one or more component(s) having the same function. Moreover, the size of the various components (resistors, width/length ratio of the MOS transistors, surface ratios of the bipolar transistors, and so on) can be calculated by those skilled in the art as a function of the operation indications described above.

Having thus described at least one illustrative embodiment of the invention, various alterations, modifications and improvements will readily occur to those skilled in the art. Such alterations, modifications, and improvements are intended to be within the spirit and scope of the invention. Accordingly, the foregoing description is by way of example only and is not intended to be limiting. The invention is limited only as defined in the following claims and the equivalents thereto.

What is claimed is:

1. A voltage regulator, having first and second inputs, for receiving an input supply voltage, and an output for controlling at least one current source of at least one logic gate, comprising:

a first resistor coupled to the first input of the voltage regulator;

a first current source of a bipolar-type, coupled between the second input and the first resistor;

a second current source of a MOS-type having an input coupled to the first input of the voltage regulator and having an output;

a third current source, coupled between the first input and the output of the voltage regulator, and mirror-connected to the second current source such that a current value of the third current source equals a current value of the second current source;

a second resistor coupled between the output of the second current source and the second input of the voltage regulator; and wherein said first current source is controlled by a voltage across the second resistor, and the current value of said second source determines a voltage at the output of the voltage regulator.

2. The voltage regulator of claim 1, wherein said second current source includes a P-channel MOS transistor having a source connected to the first input of the regulator, and a gate and a drain connected together, and wherein said third current source includes a P-channel MOS transistor having a gate coupled to the gate of the P-channel MOS transistor of the second current source and a drain coupled to the output of the voltage regulator.

3. The voltage regulator of claim 2, further comprising a bipolar-type first voltage source and a second voltage source series connected between the first current source and the second resistor, for transferring a voltage across the first current source to the second resistor to regulate a voltage across the second resistor.

4. The voltage regulator of claim 3, further comprising switches that disable the voltage regulator to prevent it from consuming energy when not in use.

5. The voltage regulator of claim 4, wherein said first current source includes a control terminal, first and second mirror-connected NPN bipolar transistors, and first and second resistors connected in series, an emitter of the first NPN bipolar transistor being connected to the second input of the voltage regulator through the first and second resistors connected in series, and an emitter of the second NPN bipolar transistor being connected to a junction between said first and second resistors, bases of the first and second NPN bipolar transistors being coupled to the control terminal of the current source, a collector of the second NPN bipolar transistor being connected to the first voltage source.

6. The voltage regulator of claim 5, wherein said first voltage source includes a PNP bipolar transistor having a collector coupled to the second input of the voltage regulator, a base connected to the collector of the second NPN bipolar transistor of the first current source, and an emitter, and wherein the second voltage source includes an N-channel MOS transistor having a gate connected to the emitter of the PNP bipolar transistor of the first voltage source, a source connected to the second resistor and a drain connected to the drain of the P-channel MOS transistor of the second current source.

7. The voltage regulator of claim 6, wherein the first resistor includes first, second and third P-channel MOS transistors having sources coupled to the supply voltage and gates coupled to a start terminal of the voltage regulator for receiving a start signal, the drain of the first P-channel MOS transistor being connected to the collector of the first NPN bipolar transistor, the drain of the second P-channel MOS transistor being coupled to the collector of the second NPN bipolar transistor, and the drain of the third P-channel MOS transistor being connected to the emitter of the N-channel MOS transistor of the first voltage source.

8. The voltage regulator of claim 7 in combination with a current source of a logic gate, the current source including an N-channel MOS transistor having a gate and a drain connected together and a source, the drain being connected to the output of the voltage regulator, and the source being coupled to the second input of the voltage regulator.

9. The voltage regulator of claim 7, further comprising a voltage-to-current converter connected between the output of the voltage regulator and the second input of the regulator, said voltage-to-current converter including an NPN bipolar transistor and a resistor, the NPN bipolar transistor having an emitter connected to the second terminal of the voltage regulator through the resistor and a collector connected to the output terminal of the voltage regulator, and wherein the voltage regulator is in combination with a current source of a logic gate, the current source including an NPN bipolar transistor and a resistor, the NPN bipolar transistor of the current source having an emitter connected to the second input of the voltage regulator through the resistor of the current source, the NPN bipolar transistor being mirror-connected to the NPN bipolar transistor of said current-to-voltage converter.

10. The voltage regulator of claim 9, further comprising an NPN bipolar compensation transistor that compensates for base currents of the current source of the logic gate, the compensation transistor having a base connected to the output of the voltage regulator, a collector connected to the first input of the voltage regulator, and an emitter connected to the base of the NPN bipolar transistor of said current-to-voltage converter.

11. The voltage regulator of claim 2, further comprising switches that disable the voltage regulator to prevent it from consuming energy when not in use.

12. The voltage regulator of claim 11, wherein said first current source includes a control terminal, first and second mirror-connected NPN bipolar transistors, and first and second resistors connected in series, an emitter of the first NPN bipolar transistor being connected to the second input of the voltage regulator through the first and second resistors connected in series, and an emitter of the second NPN bipolar transistor being connected to a junction between said first and second resistors, bases of the first and second NPN bipolar transistors being coupled to the control terminal of the current source, a collector of the second NPN bipolar transistor being connected to the first voltage source.

13. The voltage regulator of claim 3, wherein said first current source includes a control terminal, first and second mirror-connected NPN bipolar transistors, and first and second resistors connected in series, an emitter of the first NPN bipolar transistor being connected to the second input of the voltage regulator through the first and second resistors connected in series, and an emitter of the second NPN bipolar transistor being connected to a junction between said first and second resistors, bases of the first and second NPN bipolar transistors being coupled to the control terminal of the current source, a collector of the second NPN bipolar transistor being connected to the first voltage source.

14. The voltage regulator of claim 1 in combination with a current source of a logic gate, the current source including an N-channel MOS transistor having a gate and a drain connected together and a source, the drain being connected to the output of the voltage regulator, and the source being coupled to the second input of the voltage regulator.

15. The voltage regulator of claim 1, further comprising a voltage-to-current converter connected between the output of the voltage regulator and the second input of the regulator, said voltage-to-current converter including an NPN bipolar transistor and a resistor, the NPN bipolar transistor having an emitter connected to the second terminal of the voltage regulator through the resistor and a collector connected to the output terminal of the voltage regulator, and wherein the voltage regulator is in combination with a current source of a logic gate, the current source including an NPN bipolar transistor and a resistor, the NPN bipolar transistor of the current source having an emitter connected to the second input of the voltage regulator through the resistor of the current source, the NPN bipolar transistor being mirror-connected to the NPN bipolar transistor of said current-to-voltage converter.

16. A method for providing a regulated voltage from a supply voltage comprising steps of:

providing, using the supply voltage, a first current having an amplitude;

disposing a resistive element in a path of the first current to develop a first voltage;

detecting a voltage level of the first voltage;

comparing the voltage level with a reference voltage level;

modifying the amplitude of the first current when the voltage level differs from the reference voltage level; and providing an output current for providing a regulated voltage by mirroring the first current.

17. The method of claim 16, wherein the step of providing an output current includes providing a second current having an amplitude substantially the same as the first current amplitude.

18. The method of claim 16, wherein the step of generating a first current includes generating a first current from a supply voltage that does not exceed three volts.

19. A voltage regulator, having first and second inputs, for receiving an input supply voltage, and an output that provides a regulated voltage, comprising:

a first resistive element coupled to the second input of the voltage regulator;

a first current source coupled between the input of the voltage regulator and the first resistive element;

a second current source, coupled between the first input and the output of the voltage regulator, and mirror-connected to the first current source such that a current value of the second current source equals a current value of the first current source;

means for detecting a voltage across the first resistive element; and means for varying the current value of the first current source when the voltage across the first resistive element differs from a reference voltage.

20. The voltage regulator of claim 19, further comprising a control terminal and switch means for disabling the voltage regulator when a control signal is applied to the control terminal.

21. The voltage regulator of claim 19, further comprising means for converting a voltage to a current coupled between the output of the voltage regulator and the second input of the voltage regulator.

22. The voltage regulator of claim 19, wherein said first current source includes a P-channel MOS transistor having a source connected to the first input of the regulator, and a gate and a drain connected together, and wherein said second current source includes a P-channel MOS transistor having a gate coupled to the gate of the P-channel MOS transistor of the first current source and a drain coupled to the output of the voltage regulator.

23. A voltage regulator, having first and second inputs, for receiving an input supply voltage, and an output that provides a regulated voltage, comprising:

a first resistive element coupled to the second input of the voltage regulator;

a first current source coupled between the input of the voltage regulator and the first resistive element;

a second current source, coupled between the first input and the output of the voltage regulator, and mirror-connected to the first current source such that a current value of the second current source equals a current value of the first current source;

a regulation circuit coupled to the first resistive element, the first input and the second input of the voltage regulator, the regulation circuit detecting a voltage across the first resistive element and varying the current value of the first current source when the voltage across the resistive element differs from a reference value.

24. The voltage regulator of claim 23, wherein the regulation circuit includes a third current source having a control input coupled to the first resistive element, an output coupled to the second input of the voltage regulator and an input, a value of current through the third current source being controlled by the voltage across the first resistive element.

25. The voltage regulator of claim 24, wherein the regulation circuit further includes a second resistive element coupled between the input of the third current source and the first input of the voltage regulator.

26. The voltage regulator of claim 25, wherein the regulation circuit further includes first and second voltage sources, the first voltage source being coupled between the input of the third current source and the second resistive element, the second voltage source being coupled between the first and second resistive elements.

27. The voltage regulator of claim 26, further comprising a voltage to current converter coupled between the output of the voltage regulator and the second input of the voltage regulator.

28. The voltage regulator of claim 23, further comprising a voltage to current converter coupled between the output of the voltage regulator and the second input of the voltage regulator.

29. The voltage regulator of claim 23, wherein said first current source includes a P-channel MOS transistor having a source connected to the first input of the regulator, and a gate and a drain connected together, and wherein said second current source includes a P-channel MOS transistor having a gate coupled to the gate of the P-channel MOS transistor of the first current source and a drain coupled to the output of the voltage regulator.

* * * * *